US008033871B2

(12) United States Patent
Pocrass

(10) Patent No.: US 8,033,871 B2
(45) Date of Patent: Oct. 11, 2011

(54) MULTIPLE FUNCTION RJ CONNECTOR WITH SPLIT INTERNAL HOUSING OPENING CAVITY

(76) Inventor: Alan L. Pocrass, Simi Valley, CA (US)

( * ) Notice: Subject to any disclaimer, the term of this patent is extended or adjusted under 35 U.S.C. 154(b) by 88 days.

(21) Appl. No.: 12/445,658

(22) PCT Filed: Oct. 5, 2007

(86) PCT No.: PCT/US2007/080561

§ 371 (c)(1),
(2), (4) Date: Jun. 9, 2009

(87) PCT Pub. No.: WO2008/051696

PCT Pub. Date: May 2, 2008

(65) Prior Publication Data

US 2010/0317216 A1 Dec. 16, 2010

Related U.S. Application Data

(60) Provisional application No. 60/854,050, filed on Oct. 23, 2006.

(51) Int. Cl.
*H01R 24/00* (2011.01)

(52) U.S. Cl. ..... 439/676; 439/344

(58) Field of Classification Search ..... 439/676, 439/344, 636, 362, 632
See application file for complete search history.

(56) References Cited

U.S. PATENT DOCUMENTS

| | | | | |
|---|---|---|---|---|
| 4,978,317 | A | 12/1990 | Pocrass | |
| 5,308,248 | A | 5/1994 | Davidge et al. | |
| 5,647,767 | A * | 7/1997 | Scheer et al. | 439/620.17 |
| 6,474,999 | B1 * | 11/2002 | Givens et al. | 439/76.1 |
| 6,537,110 | B1 * | 3/2003 | Korsunsky et al. | 439/676 |
| 6,558,197 | B1 * | 5/2003 | Chen et al. | 439/607.21 |
| 6,739,915 | B1 * | 5/2004 | Hyland et al. | 439/676 |
| 6,752,664 | B2 * | 6/2004 | Hyland et al. | 439/620.05 |
| 6,761,595 | B1 * | 7/2004 | Zheng et al. | 439/676 |
| 6,769,936 | B2 * | 8/2004 | Gutierrez et al. | 439/676 |
| 6,988,914 | B2 | 1/2006 | Pepe et al. | |
| 7,186,128 | B1 * | 3/2007 | Wu | 439/344 |
| 7,241,181 | B2 * | 7/2007 | Machado et al. | 439/676 |
| 7,708,581 | B2 * | 5/2010 | Weiss | 439/344 |
| 2004/0209522 | A1 * | 10/2004 | Chang | 439/676 |
| 2005/0191010 | A1 | 9/2005 | Gurreri et al. | |

FOREIGN PATENT DOCUMENTS

| | | |
|---|---|---|
| CN | 2476886 | 2/2002 |
| JP | 2006066352 A | 9/2006 |

* cited by examiner

*Primary Examiner* — Hae Moon Hyeon
(74) *Attorney, Agent, or Firm* — The Webb Law Firm

(57) ABSTRACT

A multi-purpose modular RJ connector includes a female receptacle having an opening in which a printed circuit board having contact pads on opposite surfaces thereof is positioned. A male plug has a cavity operative for receiving the printed circuit board therein when the male plug is inserted in the opening of the female receptacle. The male plug includes contact pins on opposite sides of the cavity for contacting the contact pads disposed on opposite surfaces of the printed circuit board when the male plug is inserted into the opening of the female receptacle.

15 Claims, 11 Drawing Sheets

FIG. 8a
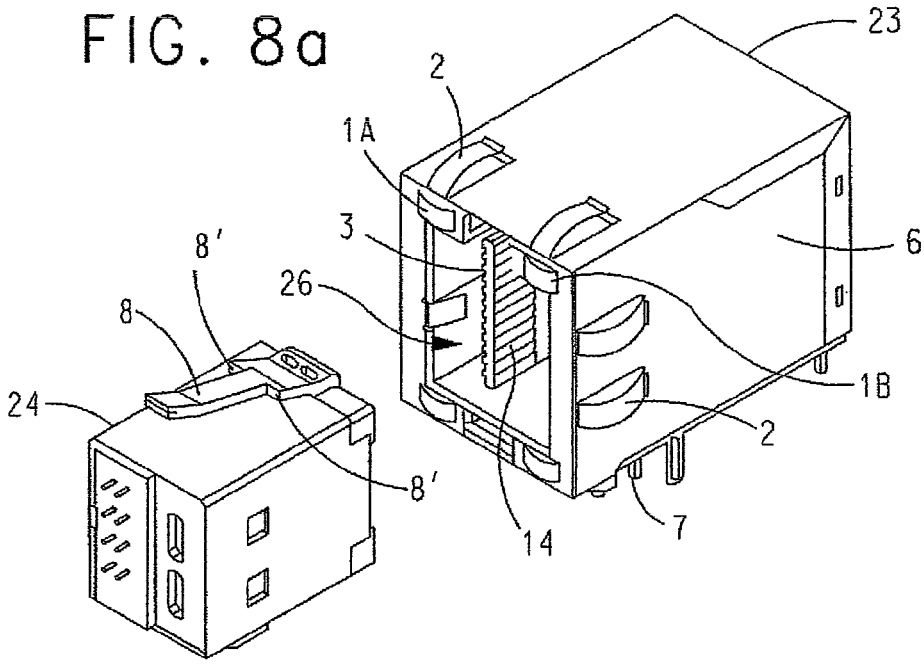
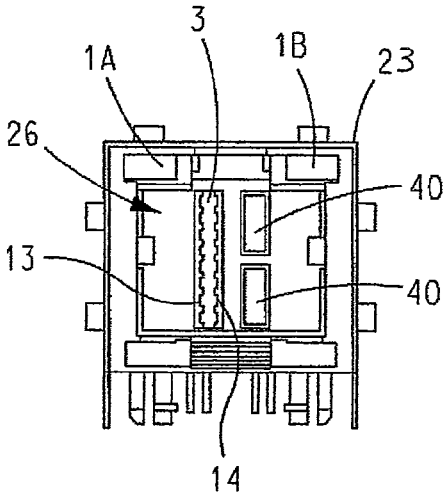
FIG. 8b
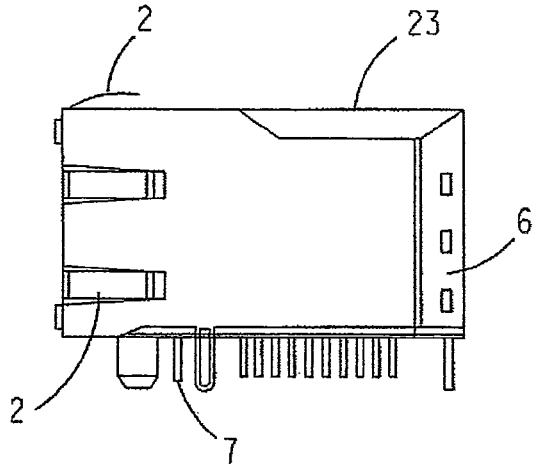
FIG. 8c

FIG. 9a
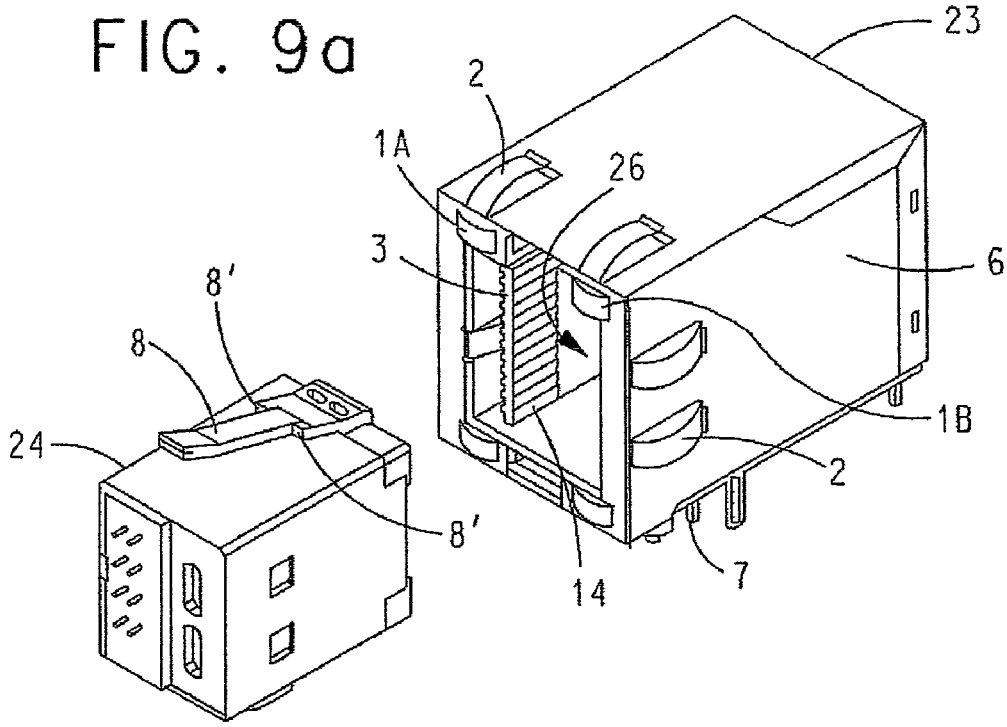
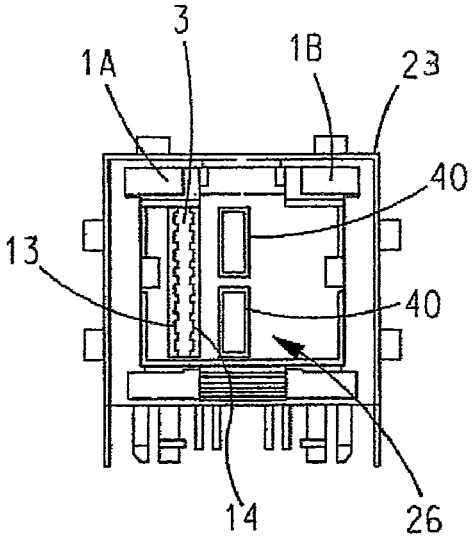
FIG. 9b
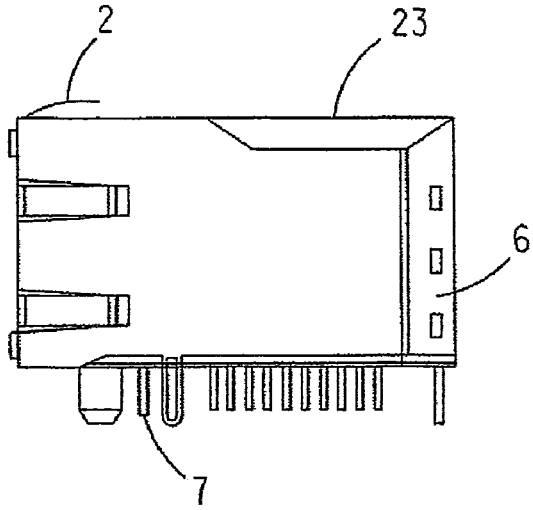
FIG. 9c

FIG. 10a
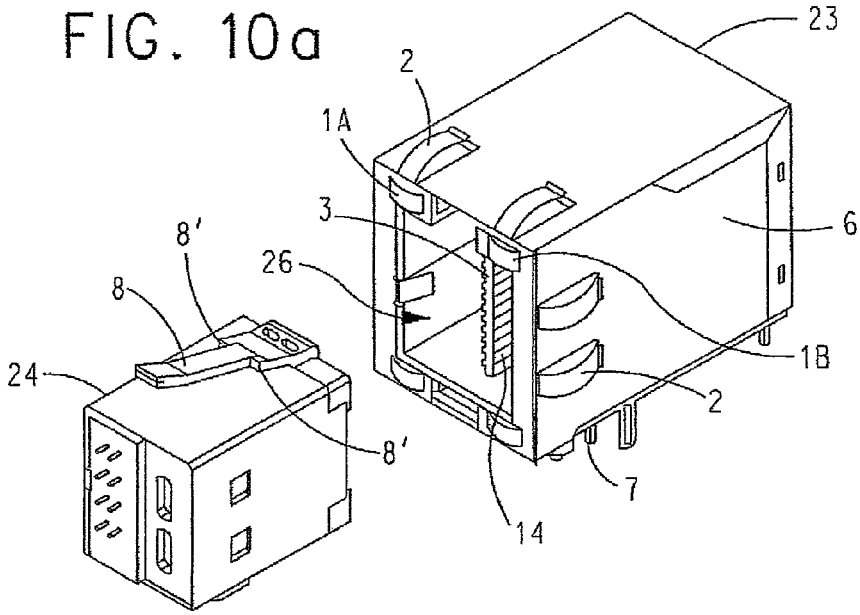
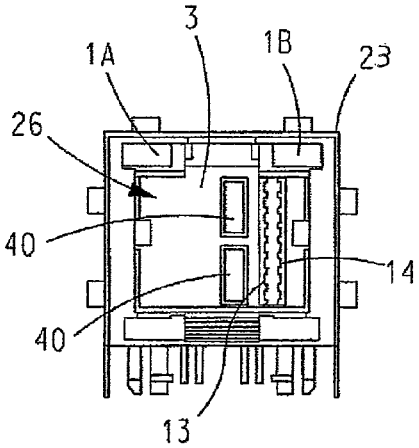
FIG. 10b
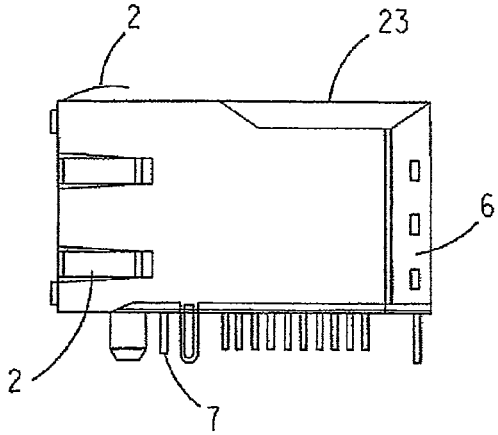
FIG. 10c

FIG. 11a
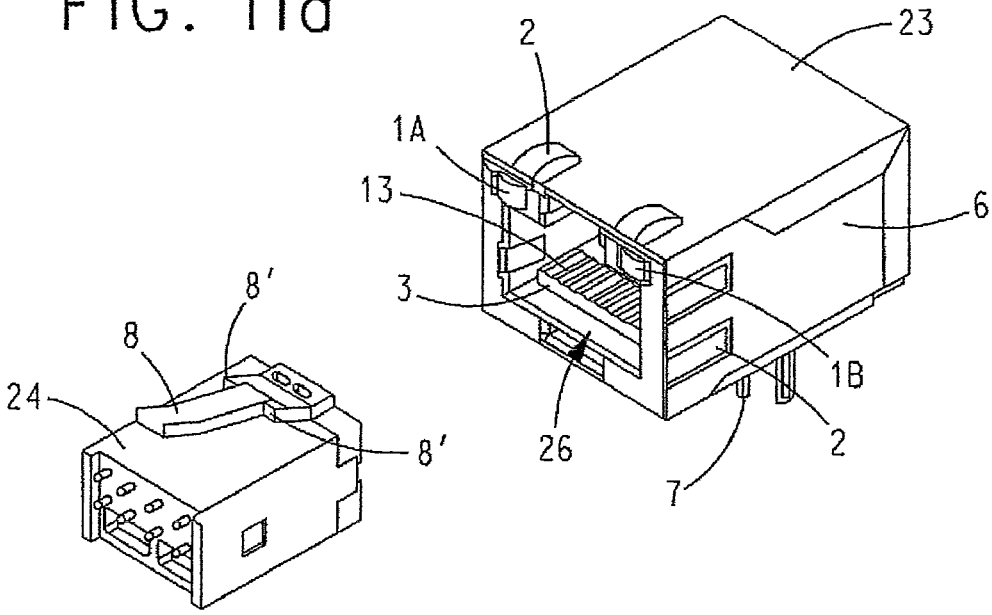
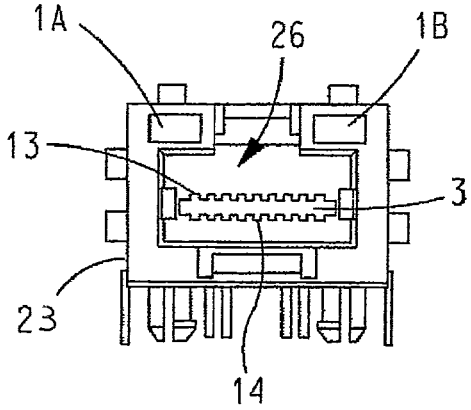
FIG. 11b
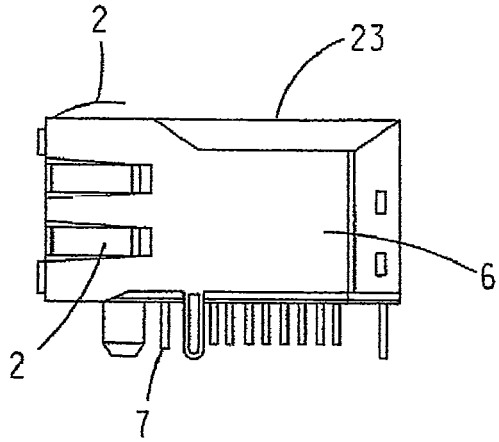
FIG. 11c

FIG. 12a
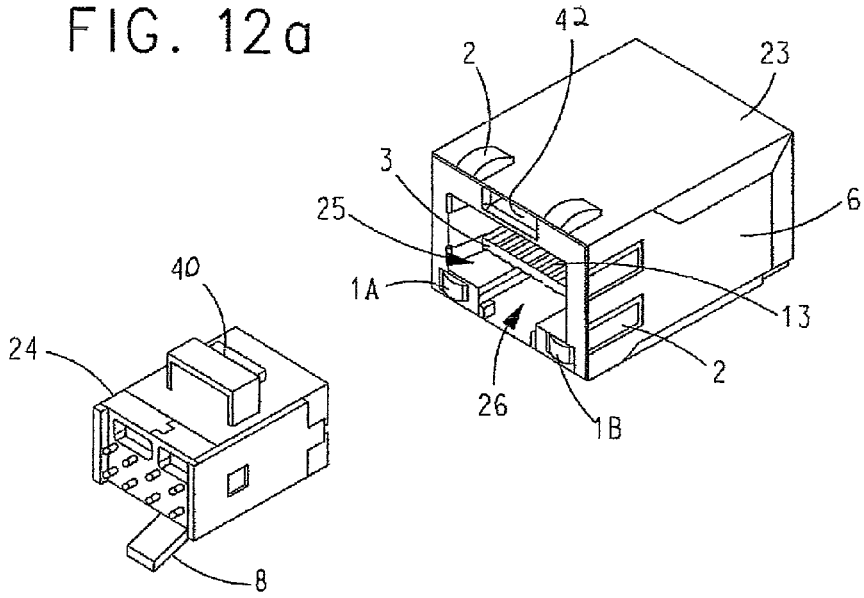
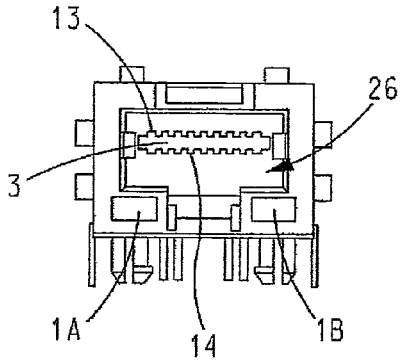
FIG. 12b
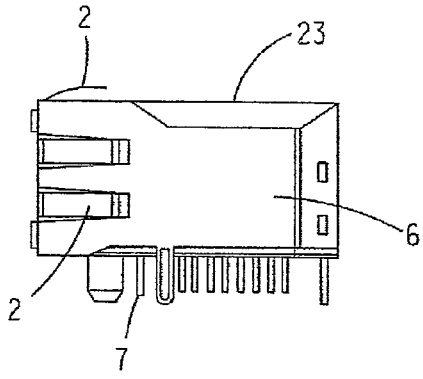
FIG. 12c

MULTIPLE FUNCTION RJ CONNECTOR WITH SPLIT INTERNAL HOUSING OPENING CAVITY

CROSS REFERENCE TO RELATED APPLICATIONS

This application claims priority from International Patent Application No. PCT/US2007/080561, filed Oct. 5, 2007, which claims priority from U.S. Provisional Patent Application No. 60/854,050, filed Oct. 23, 2006.

BACKGROUND OF THE INVENTION

1. Field of the Invention

The present invention generally relates to modular connectors having a female receptacle and a removable male plug and, more particularly, to multi-purpose modular connectors.

2. Description of Related Art

RJ-type modular connectors generally include an RJ-type female receptacle configured to releasably receive an RJ-type male plug. RJ-type modular connectors are commonly used in conjunction with electronic telecommunications, data networking equipment, and computers. The female receptacle is generally a hollow box which defines an internal cavity and four interior surfaces. A latch groove is generally defined adjacent to one of the four interior surfaces. A plurality of contact terminals is positioned inside the interior cavity adjacent to one of the four interior surfaces, desirably opposite the interior surface defining the latch groove. Each such contact terminal is electrically connected to a corresponding phone line, wire, printed circuit board lead, or some other system or device. One RJ-type modular connector is described in U.S. Pat. No. 4,978,317 to Pocrass, which is incorporated herein by reference.

The internal cavity of the female receptacle is configured to receive the male plug. The male plug is generally box-shaped and defines four external surfaces, an open end, a closed end, and usually an internal cavity. One of the four external surfaces defines a plurality of partitioned wire grooves, wherein the open end, the internal cavity, and each of the plurality of partitioned wire grooves are connected to one another. A collapsible wire holder may be defined by any one of the four external surfaces, and a flexible latch is usually positioned adjacent to the external surface positioned opposite to the external surface defining the plurality of partitioned wire grooves.

In one typical configuration, a plurality of wires is inserted into the open end of the male plug. One end of each wire is positioned in a corresponding one of the wire grooves. The collapsible wire holder is then compressed to hold each wire securely within the male plug. The male plug is then inserted into the female receptacle, such that a ridge on the flexible latch releasably seats in the latch groove, and each wire contacts a corresponding one of the contact terminals. The other end of each wire may also be individually connected to another male plug in the same manner described above, forming a plurality of individual wires having a male plug at both ends.

A significant limitation of prior art RJ-type modular connectors is that the modular connectors are dedicated to one particular function. For example, RJ11 modular connectors are often used in telecommunication applications. RJ11 female receptacles generally include up to six separate contact terminals, while the corresponding RJ11 male plug includes a like number of partitioned wire grooves. In data networking applications, an RJ45 modular connector is often used. RJ45 female receptacles generally include up to eight separate contact terminals, while the corresponding RJ45 male plug includes a like number of partitioned wire grooves RJ45 modular connectors are specially designed for Local Area Network (LAN) or ETHERNET connectivity.

Heretofore, if both telecommunication modem and networking capabilities are desired in one particular type of device, such as a personal computer, the device is generally configured with at least one RJ11 modular connector and at least one RJ45 modular connector. The need for at least two different types of modular connectors increases the size of the device, which is an unwanted design limitation, particularly with hand-held and laptop computers.

SUMMARY OF THE INVENTION

To help ease the limitations currently imposed by the prior art, an RJ-type modular connector is provided which includes an RJ-type female receptacle and an RJ-type male plug. The RJ-type female receptacle is configured to receive the RJ-type male plug. The RJ-type female receptacle has an open, plug receiving end and a printed circuit board (PCB) in the open, plug receiving end with contact terminals on both the top and bottom sides of the PCB.

The RJ-type male plug has a split cavity configured to receive the printed circuit board of the RJ-type female receptacle therein when the RJ-type male plug is inserted in the open, plug receiving end of the RJ-type female receptacle. The cavity has contact pins on opposite sides thereof configured to contact the contact terminals of the PCB when the RJ-type male plug is inserted in the open, plug receiving end of the RJ-type female receptacle.

BRIEF DESCRIPTION OF THE DRAWINGS

FIG. 8A is a perspective view of another embodiment female receptacle having a vertically oriented PCB positioned near the center of the cavity thereof and a male plug designed to be plugged into the female receptacle;

FIGS. 8B and 8C are front and side views of the female receptacle shown in FIG. 8A;

FIG. 9A is a perspective view of another embodiment female receptacle having a vertically oriented PCB positioned in spaced relation adjacent the left interior surface of the cavity thereof and a male plug designed to be plugged into the female receptacle;

FIGS. 9B and 9C are front and side views of the female receptacle shown in FIG. 9;

FIG. 10A is a perspective view of another embodiment female receptacle having a vertically oriented PCB positioned in spaced relation adjacent the right interior surface of the cavity thereof and a male plug designed to be plugged into the female receptacle;

FIGS. 10B and 10C are front and side views of the female receptacle shown in FIG. 10A;

FIG. 11A is a perspective view of another embodiment female receptacle having a horizontally oriented PCB positioned in spaced relation adjacent the bottom interior surface of the cavity thereof and a male plug designed to be plugged into the female receptacle;

FIGS. 11B and 11C are front and side views of the female receptacle shown in FIG. 11A;

FIG. 12A is a perspective view of another embodiment female receptacle having a horizontally oriented PCB positioned in spaced relation adjacent the top interior surface of the cavity thereof and a male plug designed to be plugged into the female receptacle; and FIGS. 12B and 12C are front and side views of the female receptacle shown in FIG. 12A.

DETAILED DESCRIPTION OF THE INVENTION

Figure 1B:
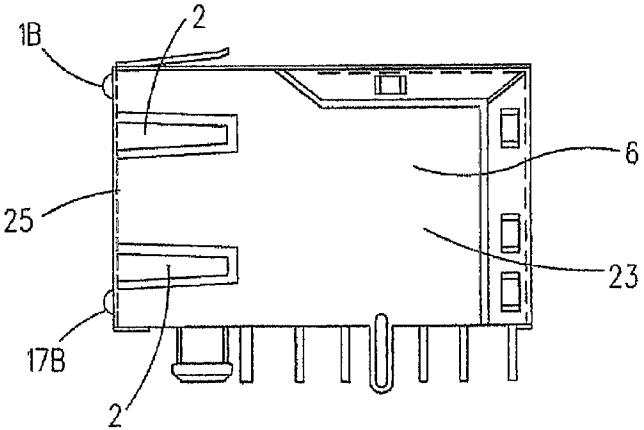
FIG. 1B is a side view of the first embodiment female receptacle with outer housing shielding shown in FIG. 1A.
Figure 1D:
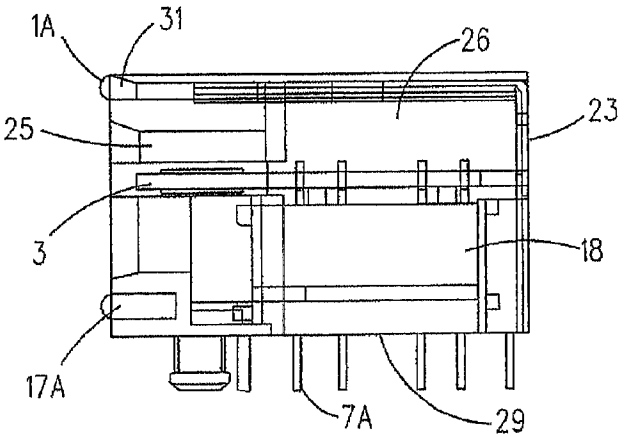
FIG. 1D is a cross-section taken along line 1D-1D in FIG. 1A.

A first embodiment female receptacle 23 is shown in FIGS. 1A, 1B, 1C, 1D, 2B and 2C. A first embodiment male plug 24 is shown in FIG. 2A and male plug 24 is shown inserted into female receptacle 23 in FIG. 2C. For the purposes of this description, the female receptacle and the male plug are of the RJ-type. However, other types of multi-purpose modular connectors may also fall within the scope and spirit of the present invention.

Female receptacle 23 is generally a hollow box-like structure defining an opening or open end 25 and an internal cavity 26. Open end 25 desirably includes latch grooves 31, 32 defined in an interior wall of internal cavity 26.

Figure 1A:
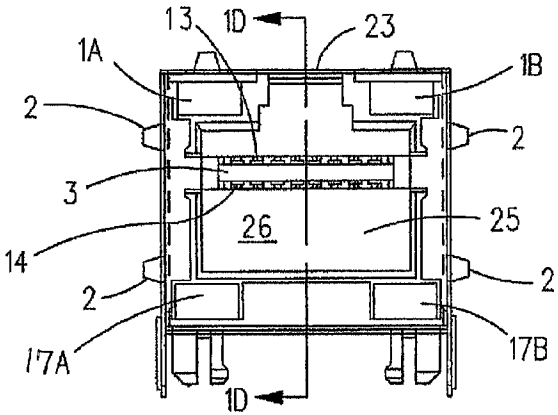
FIG. 1A is a view of the open, plug receiving end of a first embodiment female receptacle with shielding attached showing a printed circuit board (PCB) mounted in spaced relation between the top and bottom interior surfaces of the internal cavity of the first embodiment female receptacle.
Figure 1C:
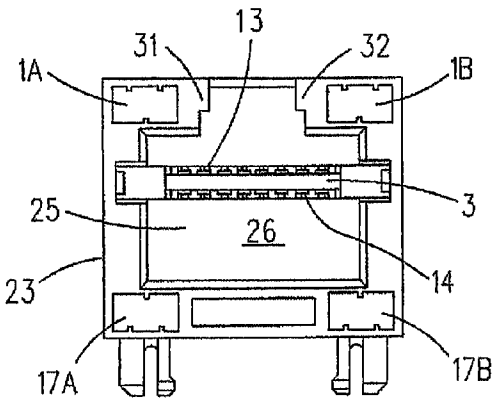
FIG. 1C is a view of the open, plug receiving end of the first embodiment female receptacle shown in FIG. 1A without the shielding attached.
Figure 2B:
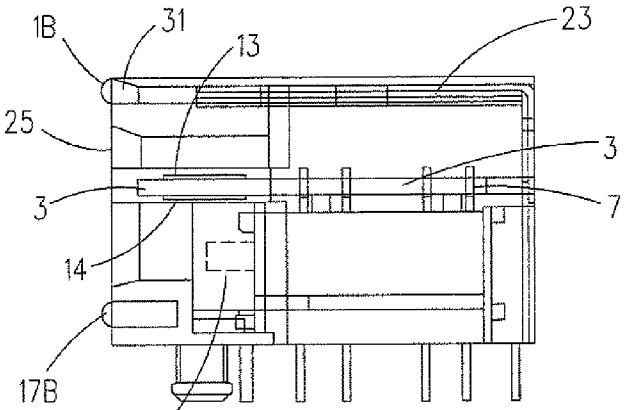
FIG. 2B is another cross-sectional side view of the first embodiment female receptacle shown in FIG. 1D.
Figure 2A:
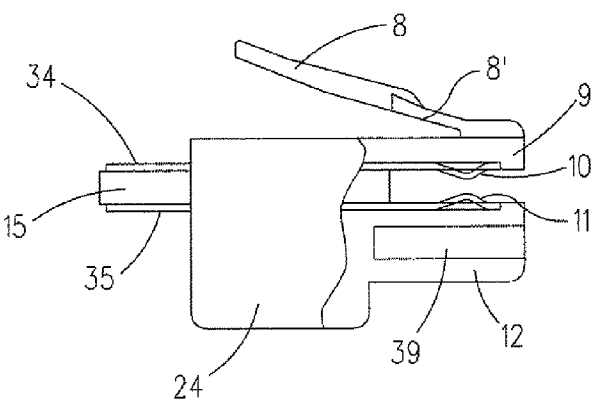
FIG. 2A is a side view of a first embodiment male plug configured to be inserted in the open, plug receiving end of the first embodiment female receptacle shown in FIG. 1A.

FIG. 1A is a front view of female receptacle 23 with the open end 25. RJ45 male plugs typically have eight wires and are generally wider than RJ11 male plugs which typically have four wires.

Figure 3B:
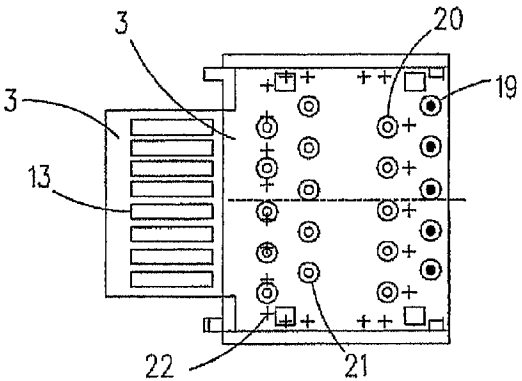
FIG. 3B is a plan view of the PCB shown in FIG. 3A.
Figure 3C:
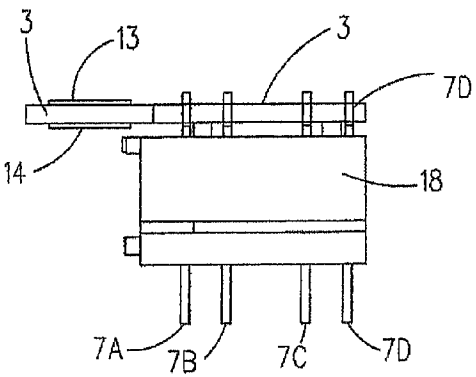
FIG. 3C is a side view of the PCB mounted to the internal housing module shown in FIG. 3A.
Figure 3A:
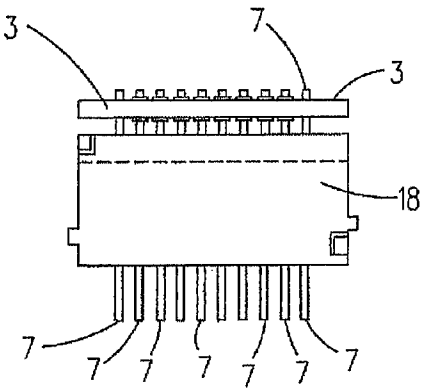
FIG. 3A is a rear view of the PCB of FIG. 1A mounted to an internal housing module section which can be integrated into the female receptacle of FIG. 1A.
Figure 6:
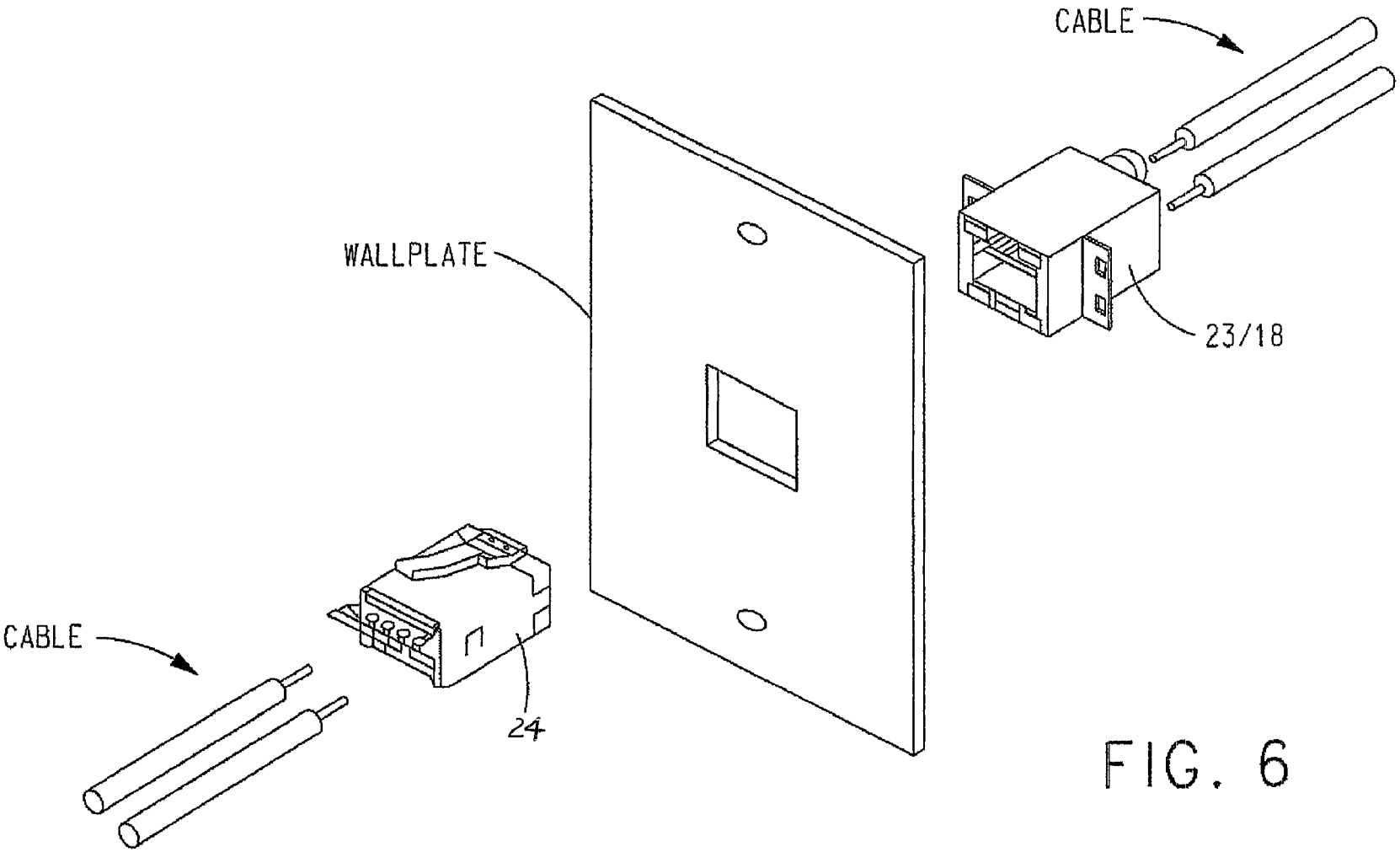
FIG. 6 is a perspective view of the combination of a wall plate, a first embodiment female receptacle (like the female receptacle of FIG. 1A, but adapted to mount to the wall plate) and the first embodiment male plug of FIG. 2A.

With reference to FIGS. 3B and 3C and with continuing reference to all previous figures, female receptacle 23 includes in internal cavity 26 a printed circuit board (PCB) 3 having multiple contact pads 13 and 14 on both the top and bottom sides or surfaces of PCB 3. PCB 3 includes internal traces (not shown) from pads 13 and 14 to contact holes disposed in rows 19, 20, 21 and 22. Each pad 13 and 14 is electrically coupled to at least one corresponding contact hole in one of rows 19, 20, 21 and 22. Contact pins 7 are inserted in the contact holes defining rows 19, 20, 21 and 22. These contact pins 7 are long enough to extend from PCB 3 through the base 29 of female receptacle 23 for connection to a printed circuit board PCB (not shown) to which female receptacle 23 is mated via pins 7. This invention can be used in this manner. However, it also can be used in RJ wall plates, like the wall plate shown in FIG. 6, and other products which use RJ-style connectors.

FIG. 2A is a male plug 24 which inserts into cavity 26 via opening 25 of female receptacle 23. Male plug 24 includes two sets of contact pins 10, 11 which make contact with the sets of contact pads 13 and 14 of female receptacle 23 when the male plug is inserted into opening 25 of female receptacle 23. Any suitable and/or desirable number of contact pins 10, 11 or contact pads 13, 14 can be provided as deemed suitable and/or desirable by the application. Accordingly, the number of contact pads and pins illustrated in the various figures is not to be construed as limiting the invention.

Figure 2C:
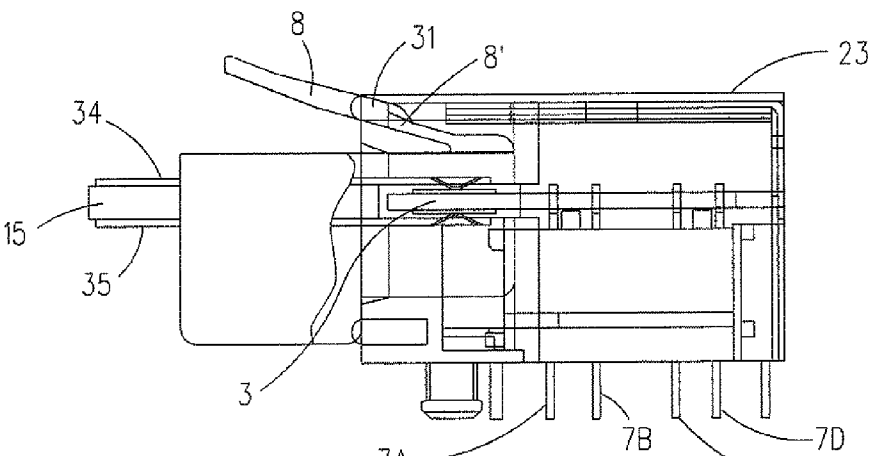
FIG. 2C is a cross-sectional side view of the first embodiment male plug of FIG. 2A inserted in the open, plug receiving end of the first embodiment female receptacle shown in FIG. 2B.

FIG. 2C shows male plug 24 inserted into the female receptacle 23 with contact pins 10 and 11 mated and touching contact pads 13 and 14, respectively, of PCB 3 inside female receptacle 23. Contact between contact pins 10 and 11 of male plug 24 and contact pads 13 and 14, respectively, of PCB 3 inside female receptacle 23 has little travel and touch firmly. It will be apparent to one skilled in the art that contact pins and pads are available in many sizes and that the contact pins 10, 11 and contact pads 13, 14 discussed above are only examples of possible applications.

Figure 7B:
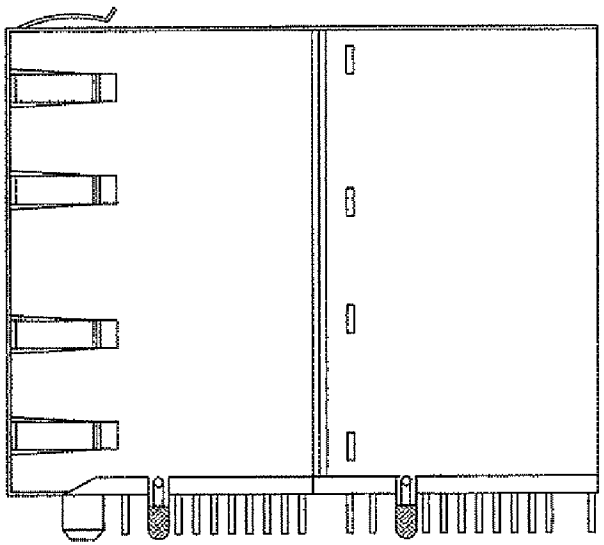
FIGS. 7A and 7B are front and side views of plural first embodiment female receptacles in a common housing.
Figure 7A:
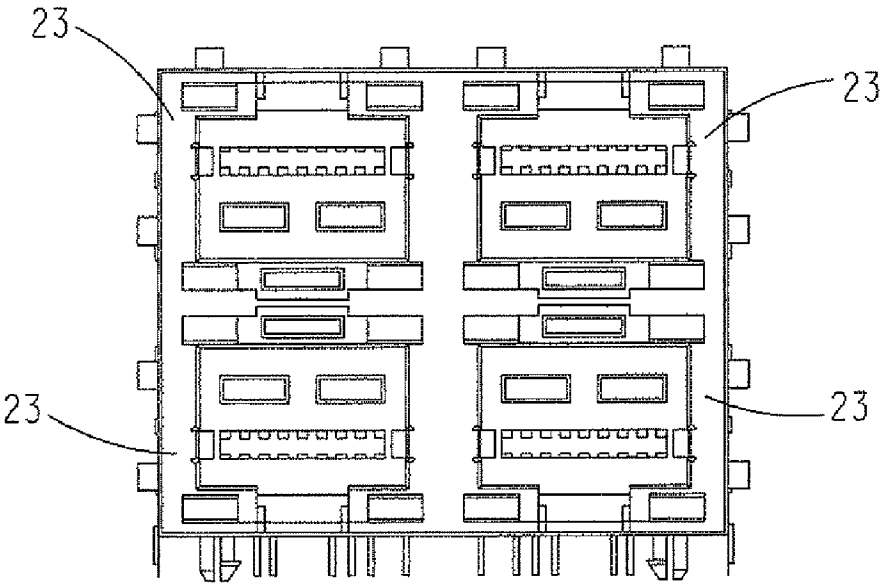

With ongoing reference to FIG. 2C, a plurality of leads or pins 7 can extend away from female receptacle 23. The ends of contact pins 7 extending outward from female receptacle 23 may be connected to one another or to some other object, such as a printed circuit board, such as by surface mounting, through-hole mounting, ball grid array, or other suitable method. Plural female receptacles 23 can be coupled together or disposed in a common housing as shown in FIGS. 7A and 7B. In FIGS. 7A and 7B, the top two female receptacles 23 have their contact pins 7 extending from the base of the common housing adjacent the backside thereof to avoid interference with the contact pins 7 of the bottom two female receptacles 23 which extend from the base adjacent the front side of the common housing. Appropriate means for routing all of the contact pins 7 of the various female receptacles 23 disposed in the common housing of FIGS. 7A and 7B is believed to be within the capability of those skilled in the art.

Referring to FIG. 2A, male plug 24 includes a spring latch 8, multiple contact pin(s) 10 and 11, top housing section 9, bottom housing section 12 and a rear printed circuit board 15 which has contact pads 34 and 35 on both the top and bottom surfaces, respectively, thereof. Rear printed circuit board 15 can include any number of contact pads 34 and 35 on opposite sides thereof deemed suitable and/or desirable for the application by one of ordinary skill in the art. Male plug 24 defines an opening between contacts 10 and 11 sized to receive PCB 3 when male plug 24 is inserted in opening 25 of female receptacle 23. Each wire of a twisted wiring cable can be attached to one or more of contact pads 34 and 35. It is envisioned that any number of contact pads 34 and 35 and any number of wires of the twisted wiring cable can be provided as deemed suitable and/or necessary by one of ordinary skill in the art.

FIG. 1A and FIG. 1B are views of the female receptacle 23 with a metal shield 6 around the top, sides and rear of female receptacle 23. Metal shield 6 can include metal tabs 2 which extend out from the shield 6. No shield covers opening 25 of female receptacle 23. Opening 25 permits male plug 24 to slide inside female receptacle 23 and snap in place with spring latch 8 received in a cutout at the top of opening 25. Spring latch 8 desirably includes latch tabs 8' on opposite sides of the elongated axis of spring latch 8. These latch tabs 8' are configured to engage the backside of latch grooves 31 and 32 along the topside of opening 25 when male plug 24 is inserted into opening 25 of female receptacle 23. The cooperation of spring latch 8 and latch tabs 8' engaging latch grooves 31 and 32 act to seat male plug 24 within opening 25 of female receptacle 23. Male plug 24 slides into opening 25 which is configured to receive male plug 24. Male plug 24 is generally box-shaped. Male plug 24 may be an RJ11-type male plug, an RJ45-type male plug, or any other suitable and/or desirable type of male plug.

One method of utilizing female receptacle 23 and male plug 24 is to connect multiple telephones or multiple devices which require RJ-type connectors.

FIG. 3C is an isolated view of the manner in which PCB 3 is supported in female receptacle 23, namely, a housing 18 to which PCB 3 is attached by soldering contact pins 7 to PCB 3. Other means to make this attachment are envisioned but soldering is an efficient means. To facilitate mating of female receptacle 23 to a printed circuit board of a user's product, contact pins 7A, 7B, 7C, 7D can be staggered or placed in horizontal rows. FIG. 3C only shows a few contact pins 7, however, female receptacle 23 can be easily configured with up to twenty contact pins 7. However, this is not to be construed as limiting the invention.

To remove male plug 24 from female receptacle 23, the end of flexible latch 8 adjacent opening 25 is urged into opening 25, whereupon latch grooves 31 and 32 unseat from latch tabs 8' of spring latch 8. The end of spring latch 8 opposite latch tabs 8' is then pressed toward male plug 24 to enable latch tabs 8' of spring latch 8 to clear latch grooves 31 and 32 whereupon male plug 24 can be withdrawn from opening 25 of female receptacle 23.

Figure 4:
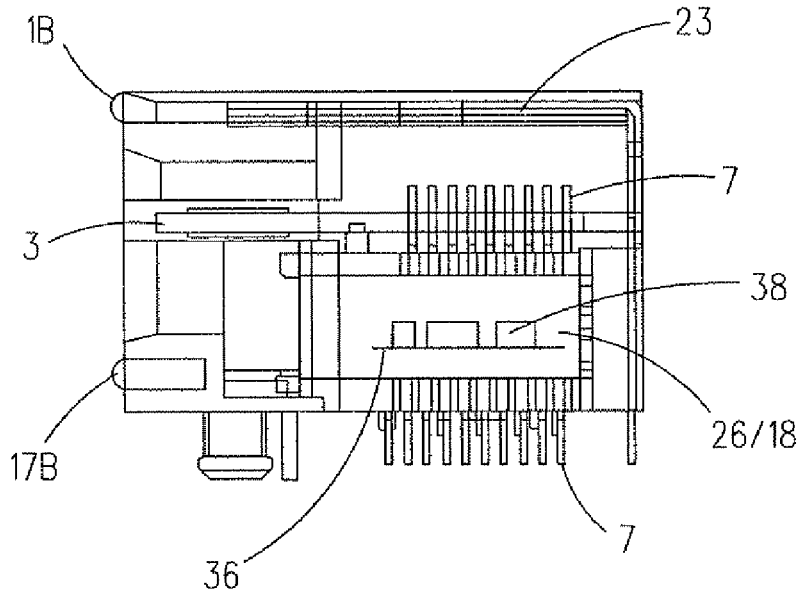
FIG. 4 is another side view of the female receptacle of FIG. 1D including integrated components on another printed circuit board disposed inside the female receptacle.

With reference to FIG. 4 and with continuing reference to all previous figures, another embodiment of female receptacle 23 includes an internal cavity 26 having disposed therein a printed circuit board 36 having one or more so-called magnetic components 38 mounted thereto to form a so-called magnetic. The one or more magnetic components 38 can be connected to one or more contact pins 7 in any suitable and/or desirable manner via printed circuit board 36.

The one or more magnetic components 38 housed in internal cavity 26 of female receptacle 23 are electronic devices that are used for local area networking, e.g., for voice and data transmission in network telephony applications in local area networks (LAN's), for connectivity of computers, servers and networking devices, etc.

Female receptacle 23 can be any suitable and/or desirable length as is deemed suitable and/or desirable in order for the one or more magnetic components 38 and printed circuit board 36 to be received inside internal cavity 26 of female receptacle 23. Although the so-called magnetic has been described above as being included in internal cavity 26, as can be seen in FIG. 4, the magnetic can be included in housing segment 18 which, in-turn, is included in internal cavity 26.

Each of the foregoing embodiments of female receptacle 23 can include Light Emitting Diodes (LED's) 1A, 1B, 17A and/or 17B as deemed suitable and/or desirable. Each LED can be connected in electrical communication with one or more contacts 13, 14 and/or contact pins 7 as deemed suitable and/or desirable.

Figure 5A:
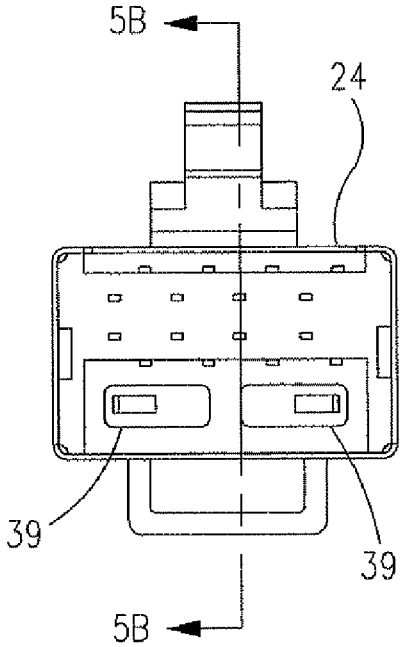
FIG. 5A is an end view of a second embodiment male plug configured to be inserted in the open, plug receiving end of the first embodiment female receptacle.
Figure 5B:
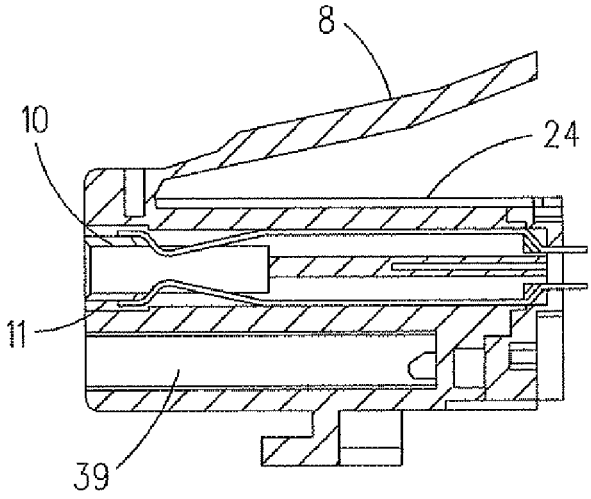
FIG. 5B is a cross-section taken along line 5B-5B in FIG. 5A.

With reference to FIGS. 5A-5B and with continuing reference to all previous figures, an alternate embodiment of male plug 24 is shown in FIGS. 5A-5B wherein rear printed circuit board 15, including contact pads 34 and 35, in the embodiment of male plug 24 shown in FIG. 2A has been omitted and replaced with the extension of contact pins 10 and 11 which terminate exteriorly (outside the rear end), of male plug 24.

Each embodiment of male plug 24 shown in FIG. 2A and FIGS. 5A-5B can include one or more elongated cavities 39, each of which is configured to receive a corresponding mating projection 40 (shown in phantom in FIG. 2B) disposed in cavity 26 of female receptacle 23 when male plug 24 is inserted into opening 25 of female receptacle 23. Each cavity 39 and mating projection 40 are configured to help align and maintain alignment of contact pins 10 and 11 with contact pads 13 and 14, respectively, when male plug 24 is inserted into opening 25 of female receptacle 23.

The embodiments described above provide an RJ-type modular connector which is extremely flexible. Instead of providing two separate female receptacles and two separate male plugs (one set for telecommunications and one set for LAN connectivity), the present invention allows one female receptacle and one male plug to be used for both purposes. For example, female receptacle 23 can be electrically connected to a printed circuit board of an electronic device, such as a motherboard of a computer that generally includes a logic processor. The computer may further include a fixed magnetic hard drive, a removable magnetic hard drive, a floppy disk drive, a CD-ROM, a visual display, and/or a printer. A first set of contact pads, e.g., contact pads 13, can be electrically connected to the electronic components on the motherboard which support a first function, such as an Ethernet networking connection for a networking user. A second set of contact pads, e.g., contact pads 14, can be electrically connected to a second Ethernet networking connection for another user in a local area networking (LAN). However, any number of first and second contact pads 13 and 14 can be used in any combination as deemed suitable and/or desirable for the particular application.

Female receptacle 23 can include integrated magnetic components 38 that provide at least one of the following: electrical isolation, transfer of LAN signals with reduced distortion, and reduction and control of electromagnetic interference. The magnetic components 38 is/are contained within the walls of female receptacle 23 and is/are connected to the contact pins 7 which can be attached to another printed circuit board of an end user.

As discussed above, the magnetic components 38 can be electronic devices, e.g., a capacitor, an inductor, a resistor, or an active electronic device, used for local area networking. Also or alternatively, the magnetic components can include an input/output module and a microprocessor (or any other suitable and/or desirable central processing unit (CPU)) to control, analyze, maintain and distribute high speed data packets. It is envisioned that this CPU could be utilized to read, write and process data packets, thereby off loading these functions from the microprocessor or CPU of any computer that incorporates female receptacle 23 or is connected thereto by male plug 24.

The embodiment of female receptacle 23 shown in FIGS. 1A-1D, 2B, 2C and 4 includes PCB 3 positioned horizontally on or near the central part of internal cavity 26. However, it is also envisioned that PCB 3 can be mounted in different orientations and in different locations within cavity 26. For example, another embodiment female housing 23 shown in FIGS. 8A-8C includes PCB 3 positioned vertically within cavity 26 near the center thereof. This embodiment of female receptacle 23 can also include one or more mating projections 40.

Another embodiment female housing shown in FIGS. 9A-9C includes PCB 3 positioned vertically in cavity 26 near the left interior surface thereof. This embodiment of female receptacle 23 can also include one or mating projections 40.

Another embodiment female housing 23 shown in FIGS. 10A-10B includes PCB 3 positioned vertically in cavity 26 near the right interior surface thereof. This embodiment of female housing 23 can also include one or more mating projections 40.

Another embodiment female housing 23 shown in FIGS. 11A-11C includes PCB 3 positioned horizontally in cavity 26 near the bottom interior surface thereof.

Lastly, another embodiment female housing 23 shown in FIGS. 12A-12C includes PCB positioned horizontally in cavity 26 near the top interior surface thereof. The embodiment of housing 23 shown in FIGS. 12A-12C also includes a slot 42 positioned above opening 25 for receiving a projection 40 disposed in spaced relation to a top surface of male plug 24 when male plug 24 is plugged into internal cavity 26 of female receptacle 23 via opening 25 thereof. This slot 42 and projection 40 combination can be used on any of the embodiments of female and male connectors described herein.

The invention has been described with reference to the preferred embodiments. Obvious modifications and alterations will occur to others upon reading and understanding the preceding detailed description. For example, while each embodiment female housing shown in the figures has contact pads 13 and 14 on the opposite sides or surfaces of PCB 3, this is not to be construed as limiting the invention since it is envisioned that PCB 3 can have one or more contact pads on only one side or surface thereof. It is intended that the invention be construed as including all such modifications and alterations insofar as they come within the scope of the appended claims or the equivalents thereof.

The invention claimed is:

1. A multi-function connector comprising:

an RJ-type female receptacle having an open, plug receiving end;

a printed circuit board (PCB) disposed inside RJ-type the female receptacle with an edge of the PCB facing the open, plug receiving end and with sides of the PCB positioned spaced from interior surfaces of the RJ-type female receptacle that define the open, plug receiving end thereof;

first and second sets of rigid contacts disposed on opposite sides of the PCB adjacent the edge; and an RJ-type male plug configured to be received in the open, plug receiving end of the RJ-type female receptacle, the RJ-type male plug including a cavity having first and second sets of contacts on opposite sides thereof, the cavity operative for receiving the edge of the PCB therein when the RJ-type male plug is inserted in the open, plug receiving end of the RJ-type female receptacle, whereupon the contacts of the first and second sets of contacts of the RJ-type male plug make contact with the contacts of the first and second sets of contacts of the PCB.

2. The connector of claim 1, further including:

a plurality of pins extending from a position inside the RJ-type female receptacle to a position exteriorly thereof, wherein each pin is coupled in electrical communication with at least one contact of the PCB.

3. The connector of claim 2, wherein the portions of the pins disposed exteriorly of the RJ-type female receptacle are connected to another printed circuit board by way of surface mounting, through-hole mounting or ball grid array mounting.

4. The connector of claim 2, further including:

at least one magnetic component coupled to one of the pins that extend from a position inside the RJ-type female receptacle to the position exteriorly thereof

5. The connector of claim 4, wherein the magnetic component is a capacitor, an inductor, a resistor, or an active electronic device.

6. The connector of claim 1, further including:

a light emitting diode supported by the RJ-type female receptacle, said light emitting diode coupled in electrical communication with at least one contact of the PCB.

7. The connector of claim 4, wherein the light emitting diode is incorporated in the RJ-type female receptacle.

8. The connector of claim 2, further including another PCB disposed inside the RJ-type female receptacle and supporting electrical components thereon in electrical communication with one or more pins that extend from the interior of the RJ-type female receptacle to the exterior thereof.

9. The connector of claim 1, further comprising means for releasably locking the RJ-type male plug in the RJ-type female receptacle.

10. The connector of claim 9, wherein the means for releasably locking includes a latch groove defined by at least one of the interior surfaces of the RJ-type female receptacle, and a tab defined on a flexible latch of the RJ-type male plug, wherein the tab releasably engages the latch groove when the RJ-type male plug is received in the open, plug receiving end of the RJ-type female receptacle.

11. The connector of claim 1, wherein the RJ-type male plug is either an RJ11-type male plug or an RJ45-type male plug.

12. The connector of claim 1, further including a microprocessor or central processing unit disposed inside the RJ-type female receptacle and operative for controlling, maintaining and distributing data packets impressed upon one or more contacts of the PCB.

13. The connector of claim 1, wherein the first and second sets of rigid contacts disposed on opposite sides of the PCB are first and second sets of contact pads on the PCB.

14. A multi-function connector comprising:

an RJ-type female receptacle having an open, plug receiving end;

a printed circuit board (PCB) disposed inside the RJ-type female receptacle with an edge of the PCB facing the open, plug receiving end and with sides of the PCB positioned spaced from interior surfaces of the RJ-type female receptacle that define the open, plug receiving end thereof;

rigid contacts disposed on opposite sides of the PCB adjacent the edge; and an RJ-type male plug configured to be inserted in the open, plug receiving end of the RJ-type female receptacle, the RJ-type male plug having a cavity with top and bottom surfaces, each of which supports at least one contact in a manner to contact at least one contact of the PCB when the RJ-type male plug is inserted in the open, plug receiving end of the RJ-type female receptacle.

15. The connector of claim 14, wherein the rigid contacts disposed on opposite sides of the PCB are contact pads on the PCB.

* * * * *

UNITED STATES PATENT AND TRADEMARK OFFICE

CERTIFICATE OF CORRECTION

PATENT NO. : 8,033,871 B2
APPLICATION NO. : 12/445658
DATED : October 11, 2011
INVENTOR(S) : Alan L. Pocrass It is certified that error appears in the above-identified patent and that said Letters Patent is hereby corrected as shown below:

Column 7, Line 44, Claim 1, delete "RJ-type the" and insert -- the RJ-type --

Column 8, Line 9, Claim 4, delete "thereof" and insert -- thereof. --

Signed and Sealed this
Fourteenth Day of February, 2012

David J. Kappos

David J. Kappos
*Director of the United States Patent and Trademark Office*